US005777282A

United States Patent [19]

Ishiguro et al.

[11] Patent Number: 5,777,282

[45] Date of Patent: Jul. 7, 1998

[54] PUSH-BUTTON SWITCH

[75] Inventors: Kazuyoshi Ishiguro; Masuo Noda; Hiroshi Kataoka; Shinji Iwama, all of Aichi, Japan

[73] Assignees: Kabushiki Kaisha Tokai Rika Denki Seisakusho, Aichi; Denso Corporation, Kariya, both of Japan

[21] Appl. No.: 728,065

[22] Filed: Oct. 9, 1996

[30] Foreign Application Priority Data

Oct. 9, 1995 [JP] Japan ..... 7-288050

[51] Int. Cl.[6] ..... H01H 9/26

[52] U.S. Cl. ..... 200/5 E; 200/5 EA

[58] Field of Search ..... 200/5 R, 5 A, 200/5 B, 5 C, 5 D, 5 E, 5 EA, 5 EB, 520, 523, 530

[56] References Cited

U.S. PATENT DOCUMENTS

| | | | |
|---|---|---|---|
| 4,196,322 | 4/1980 | Hattori | 200/5 R |
| 4,447,686 | 5/1984 | Fieber et al. | 200/5 EA |
| 5,187,335 | 2/1993 | Fukuyama et al. | 200/5 B |
| 5,329,080 | 7/1994 | Pierce | 200/5 B |

*Primary Examiner*—Matthew V. Nguyen

*Attorney, Agent, or Firm*—Morgan, Lewis & Bockius LLP

[57] ABSTRACT

Contact holders accommodated in defined regions are elastically returned to initial positions on the side of a wall. At the initial positions, stoppers are formed integral with a wall which defines the regions, in such a manner that the stoppers are in parallel with the wall and spaced a distance from the wall. Those stoppers are each in the form of a thin plate, and have protrusions which are extended towards the contact holders, respectively. Hence, when returning to the initial positions, the contact holders and strike against the protrusions of the stoppers, so that the latter are bent towards the wall while reducing the distance, thus decreasing the impact thereon when the contact holders strike against the stoppers.

11 Claims, 4 Drawing Sheets

PUSH-BUTTON SWITCH

BACKGROUND OF THE INVENTION

1. Field of the invention

This invention relates to a push-button switch in which a spring and a movable member are accommodated in a region which is defined in a casing, and when a knob is depressed as required, the movable member is moved from an initial position to a forward position against the elastic force of the spring, and when a predetermined condition is satisfied, the spring causes the movable member to return to the initial position.

2. Related Art

In general, a push-button switch of this type is designed as follows: A movable member forming a switch mechanism has an armature which opens and closes contact means in such a manner that, when the movable member is at an initial position, the contact means is opened, and when it is at a forward position, the contact means is closed. The movable member is moved from the initial position to the forward position when the knob is suitably depressed; and it is returned to the initial position when the knob is released or it is depressed again. The force of moving the movable member is attributed to the elastic force of a spring.

On the other hand, there is available a push-button switch which has two switch mechanisms with their own operating knobs which are separately operated to open and close their own contact means. Some of the push-button switches of this type are so designed that, when the operating knob of one of the two switch mechanisms is depressed, the movable member of the other switch mechanism is forcibly returned to the initial position.

In the case where the movable member is returned to the initial position in the above-described manner, it is elastically forced against a stopper provided at the initial position, thus being stopped. When the movable member strikes the stopper, an impact sound is produced. The impact sound does not adversely affect the function of the switch. However, in the case where the push-button switch is installed in a motor vehicle which is so designed that its passenger room is silent, the impact sound may make the passenger uncomfortable. Hence, in a conventional push-button switch, the stopper against which the movable member strikes is made of an elastic material such as rubber, and the stopper of rubber is built in the casing of the switch.

In order to reduce the weight of the push-button switch and to improve the productivity thereof, its various components including the casing and others are formed by using resinous materials such as ABS and POM. In order to make the stopper of rubber in the casing of resin, it is necessary to provide an assembling step of building the stopper in the casing. Hence, the conventional push-button switch suffers from the difficulties that it is large in the number of manufacturing steps, and high in component cost. On the other hand, a recent trend in motor vehicles is to form a compact push-button switch and accordingly the stopper, which is one of the components of the switch, is smaller in size. This fact makes it rather difficult to form the stopper of rubber in the casing. Conversely, it is virtually impossible to practically decrease the impact sound which may be produced when the movable member strikes against the stopper, if the stopper of rubber is replaced by a resin stopper.

SUMMARY OF THE INVENTION

The foregoing object of the invention has been achieved by the production of push-button switches according to first and second aspects of the invention.

A push-button switch according to the first aspect of the invention has a switch mechanism comprising a casing, and a spring and a movable member which are accommodated in a region which is defined in the casing, in which, when a knob is depressed as required, the movable member is moved from an initial position to a forward position opposed by the elastic force of the spring, and when a predetermined condition is satisfied, the elastic force of the spring causes the movable member to return to the initial position. In the switch, at its initial position, a stopper is provided which functions when the movable member is returned. The stopper is formed integral with a wall of the casing which defines the region, serving as an elastic piece for lessening an impact on the movable member when the latter is returned by the spring.

The push-button switch according to the first aspect of the invention is advantageous as follows: In the push-button switch, the stopper at the initial position acts as the elastic piece for lessening the impact on the movable member. Hence, even when the movable member strikes against the stopper being returned to the initial position by the elastic force, the impact is lessened, and accordingly the impact sound is decreased. Furthermore, the stopper is formed integral with the wall of the casing which defines the region therein. This feature eliminates the assembling step of setting the stopper in the casing. Hence, in the push-button switch of the invention, when compared with a push-button switch which employs merely a resin stopper, the impact sound which may be produced when the movable member is returned is small, and not only the number of manufacturing steps is lessened, but also the manufacturing cost is lowered.

In the above-described push-button switch, the predetermined condition is that the knob is depressed again. Hence, even in the case where the movable member is returned to the initial position in response to the depression of the knob, which has been depressed once, the resultant impact sound is decreased to some extent. In addition, with the push-button switch of the present invention, not only the number of manufacturing steps but also the manufacturing cost is decreased.

The push-button switch according to the second aspect of the invention has:

first and second switch mechanisms each of which includes a casing, and a spring and a movable member which are accommodated in a region which is defined in the casing, in which, when a knob is depressed as required, the movable member is moved from an initial position to a forward position opposed by the elastic force of the spring, and when the knob is depressed again, the elastic force of the spring causes the movable member to return to the initial position; and a cancel mechanism in which, when under the condition that the movable member of one of the first and second switch mechanisms is at the forward position, a predetermined amount of depression is applied to the other switch mechanism, the movable member of the one switch mechanisms is forcibly returned to the initial position by the elastic force whether or not the knob is depressed again.

In the push-button switch thus configured, at the initial position of each of the first and second switch mechanisms, a stopper is provided which functions when the movable member is returned. The stopper is formed integral with a wall of the casing which defines the region, serving as an elastic piece for lessening an impact on the movable member when the latter is returned by the spring.

When, in the switch according to the second aspect of the invention, the movable member of each of the switch mechanisms strikes against the stopper being returned to the initial position in response to the second depression of the operating knob, the resultant impact on the movable member at the stopper is lessened, and accordingly the impact sound is decreased. Furthermore, even in the case, where the cancel mechanism functions in such a manner that, when the operating knob of one of the switch mechanisms is depressed, the movable member of the other switch mechanism is forcibly returned to the initial position by the elastic force, the resultant impact on the movable member at the stopper is lessened, and accordingly the impact sound is lessened. In each of the switch mechanisms, the stopper is formed integral with the wall of the casing which defines the region for accommodating the movable member, and therefore it is unnecessary to provide an assembling step of setting the stopper in the casing. Hence, with the push-button switch according to the second aspect of the invention, when compared with a push-button switch which employs merely a resin stopper, the impact sound which may be produced when the movable member is returned is small, and not only the number of manufacturing steps is lessened, but also the manufacturing cost is lowered.

In the push-button switch according to the first aspect of the invention, the predetermined condition for elastically returning the movable member to the initial position may be such that, after the operating knob is depressed, as required to move the movable member from the initial position against the elastic force of the spring, the knob is released. That is, the predetermined condition may be a simple operation in that the operating knob is depressed to move the movable member from the initial position opposed by the elastic force of the spring, and then the knob is released so that the movable member is returned to the initial position by the elastic force of the spring.

In the push-button switch according to the second aspect of the invention, the first and second switch mechanisms may be accommodated in the casing in such a manner that they are located adjacent to each other.

The above-described push-button switch of the invention may be modified as follows: In a first modification, the stopper formed integral with the wall of the casing which defines the region may be in the form of a thin plate which is in parallel with the wall of the casing which is perpendicular to the direction of movement of the movable member with a clearance between the stopper and the plate, and has at least a portion which is curved towards the movable member.

The above-described first modification functions as follows: When the movable member is returned to the initial position by the elastic force, it strikes against the outwardly curved portion of the stopper which is in the form of a thin plate. In this operation, the stopper, being in the form of a thin plate as was described above, is bent towards the wall of the casing which is perpendicular to the movement of the movable member, thereby to lessen the resultant impact on the stopper. Accordingly, the impact sound is smaller than which may be produced when the movable member strikes against the stopper.

BRIEF DESCRIPTION OF THE DRAWING(S)

FIGS. 1 (*a*) to (*c*) includes a front view, a plan view, and a side view, showing an external appearance of a push-button switch, which is a preferred embodiment of the invention;

DETAILED DESCRIPTION OF THE EMBODIMENTS

As conducive to a full understanding of the invention described above, its preferred embodiment will be described with reference to the accompanying drawings.

Figure 1A:
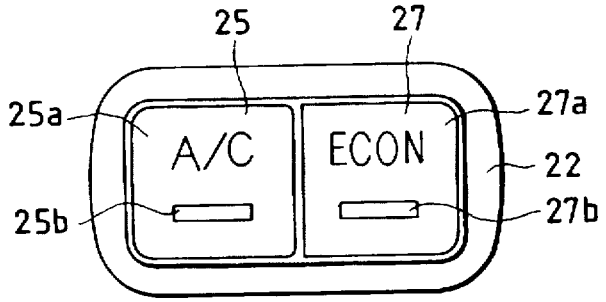
Figure 1B:
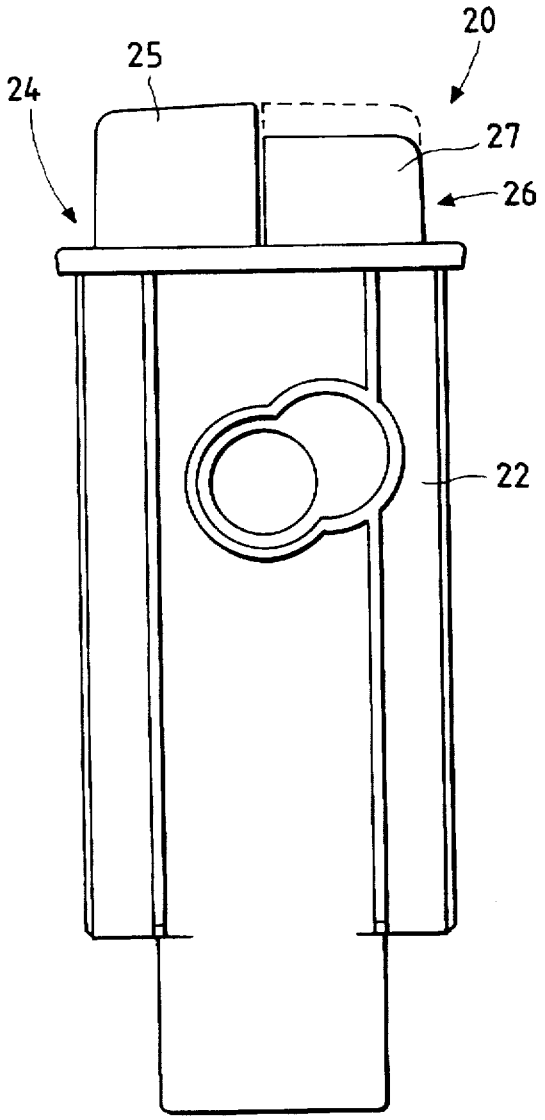
Figure 1C:
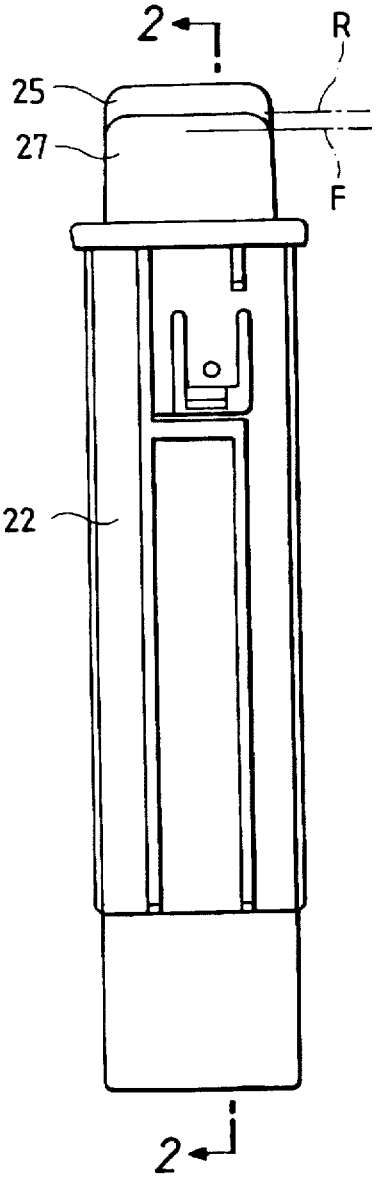

FIG. 1(*a*) to (*c*) is a diagram including a front view, plan view and a side view, showing an external appearance of a push-button switch 20, which constitutes the embodiment of the invention. The push-button switch 20 is a so-called "interlocking switch" which is employed as an air-conditioner switch in a motor vehicle. The switch 20 includes a housing 22 which accommodates a first switch 24, and a second switch 26. The first switch 24 has an operating knob 25 which is extended outside the housing 22, and similarly the second switch 26 has an operating knob 27 which is extended outside the housing 22. The first switch 24 is the main switch of the air conditioner. As shown in the plan view, the operating knob 25 has a display section 25*a* (A/C) and an "ON" indication section 25*b*. The second switch 26 is a so-called "economy mode switch" used to control the operation of the air conditioner. The operating knob 27 has a display section 27*a* (ECON), and an "ON" indication section 27*b*.

Prior to describing the structure of the first and second switches 24 and 26, the operations of those switches 24 and 26 will be outlined.

As shown in the front view of FIG. 1(*b*), each of the first and second switches 24 and 26 has two positions—an initial position where the operating knob is maximumly protruded (the first switch 24 being at the initial position in the front view), and a forward position which is closer to the housing 22 (the second switch 26 being at the forward position in the front view). When each of the operating knobs is depressed as required, it is moved from the initial position to the forward position, and retained there. For instance, when the operating knob 27 of the second switch 26 which is at the forward position, is depressed again, it is returned from the forward position to the initial position. The same thing may be said about the first switch 24.

The push-button switch 20 incorporates a cancel mechanism (described later) which interlocks the first and second switches 24 and 26 with each other. With the cancel mechanism, the switches are moved as follows: When, in the case where one (the second switch 26) of the switches is at the forward position as shown in FIG. 1(*b*), the knob of the other switch (the first switch 24) is depressed as required, then the first switch 24 is moved from the initial position to the forward position, where it is held, while the second switch 26 held at the forward position is forcibly returned to the initial position from the forward position irrespective of the depression of the operating knob 27 (even if the latter 27 is not depressed). Hereinafter, this forcible return of the switch to the initial position will be referred to as "cancel return", in order to distinguish it from the single return of the switch which is solely operated.

As each of the operating knobs is depressed in the above-described manner, it is moved from the initial postilion to the forward position, and it is held there; that is, the operating knob is pushed to the position indicated by the one-dot chain line F in FIG. 1(*c*) (corresponding to the full stroke of the operating knob), and then returned to the forward position indicated by the one-dot chain line R in FIG. 1(*c*) (corresponding to the rock stroke of the operating knob). On the other hand, in the case where each operating knob, being depressed, is returned from the forward position to the initial position, it is once pushed from the forward position (indicated by the one-dot-chain line R in FIG. 1(*c*)) to the full-stroke position (indicated by the one-dot-chain line F in FIG. 1(*c*)), and then returned to the initial position.

Figure 2:
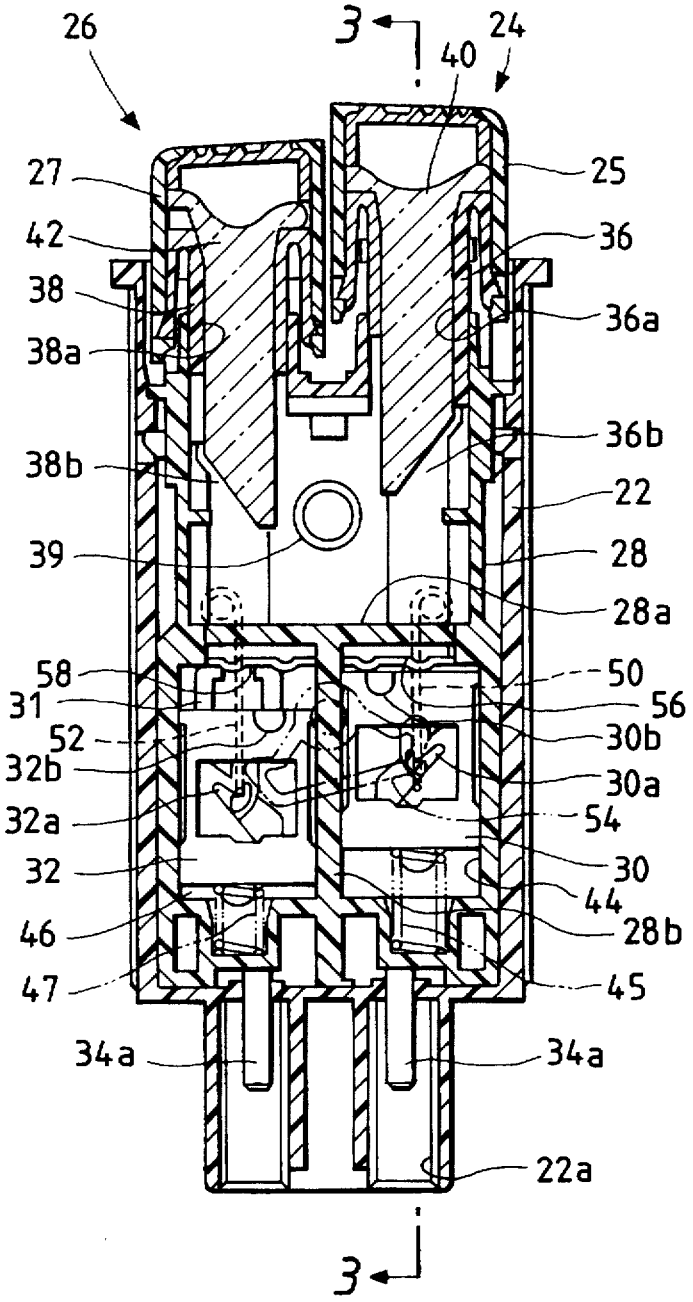
FIG. 2 is a sectional view taken along line 2—2 in FIG. 1.

The push-button switch 20 operating as described above has a body 28 inside the housing 22 as shown in FIG. 2, which is a sectional view taken along line 2—2 in FIG. 1(*c*). In order to accommodate contact holders etc. (described later) in the housing 22, the body 28 is used to divide the latter 22 into parts as follows: The body 28 includes a middle wall 28*a* which divides the internal space of the housing 22 into two parts, namely, the upper and lower spaces. The upper space accommodates the operating sections of the first and second switches 24 and 26, and the lower space accommodates movable members of those two switches, namely, contact holders 30 and 32. The contact holder accommodating space is divided into two parts by the central wall 28*b* of the body 28, in which the contact holders 30 and 32 are accommodated, respectively. The contact holders 30 and 32 thus accommodated are moved up and down as viewed in FIG. 2. In the embodiment, in order to reduce the weight of the push-button switch and to improve the productivity of the latter, various members such as the housing 22 and the body 28 are made of suitable resin (for instance ABS and POM).

Figure 3:
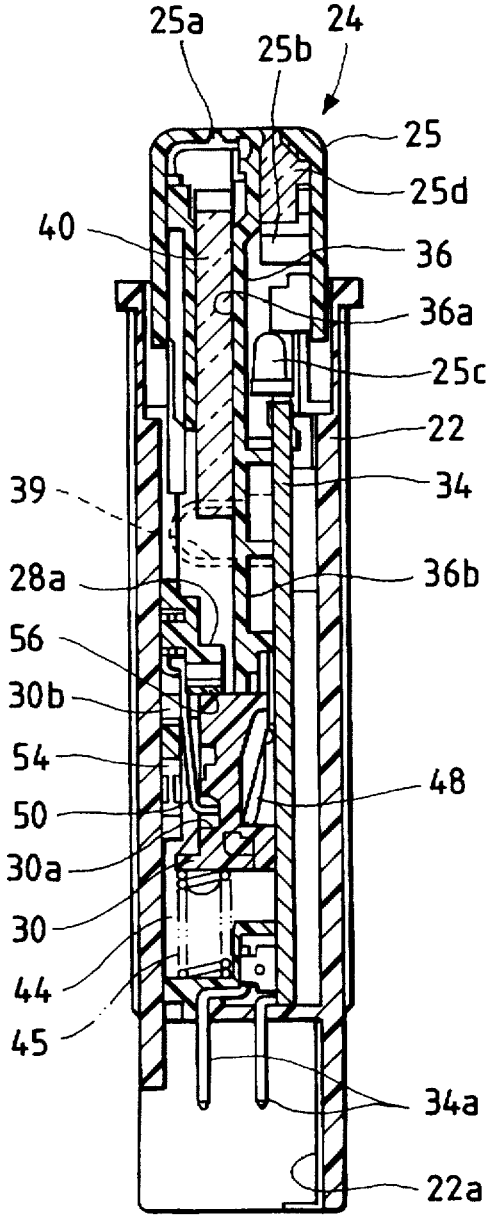
FIG. 3 is a sectional view taken along line 3—3 in FIG. 2.

As shown in FIG. 3, which is a sectional view taken along line 3—3 in FIG. 2, a printed circuit board 34 is built in the housing 22. The printed circuit board 34 includes the contacts of the push-button switch 20. The connector terminals 34*a* of the printed circuit board 34 are arranged in the connector inserting hole 22*a* of the housing 22. On the upper side of the printed circuit board 34 (on the right side in FIG. 3), knob bodies 36 and 38, to which the aforementioned switch operating knobs 25 and 27 are secured, are provided. The knob bodies 36 and 38 are moved (vertically in FIG. 2) together with the operating knobs 25 and 27, respectively, when the latter are depressed in the above-described manner.

The knob bodies 36 and 38 include hollow portions 36*a* and 38*a* on the sides where the operating knobs 25 and 27 are secured. In the hollow portions 36*a* and 38*a*, light guides 40 and 42 are fitted to lead the light of a lamp 39 to the operating knobs 25 and 27. The light guides 40 and 42 are made of transparent resin such as acrylic resin. Hence, when the lamp 39 is turned on, the output light of the latter 39 is led through the light guides 40 and 42 to the operating knobs 25 and 27 to irradiate the display sections 25*a* and 27*a*. The "ON " indication sections 25*b* and 27*b* of the operating knobs are irradiated by LEDs (light emitting diodes) provided on the printed circuit board 34, respectively (FIG. 3 shows an LED 25*c* for irradiating the ON indicator section 25*b*, and a lens 25*d*). On the other hand, the knob bodies 36 and 38 have coupling pieces 36*b* and 38*b* which are coupled to the hollow portions 36*a* and 38*a* through a partition wall (which is on the side of the printed circuit board 34). The end portions of the coupling pieces 36*b* and 38*b* are fixedly engaged with the contact holders 30 and 32 through engaging arms 31 thereof (cf. the second switch 26 in FIG. 2).

The contact holders 30 and 32 together with springs 45 and 47 are accommodated in regions 44 and 46, respectively, which are defined by the walls 28*a* and 28*b* of the body 28, in such a manner that the contact holders 30 and 32 are vertically movable in the regions 44 and 46. The springs 45 and 47 urge the contact holders 30 and 32 upwardly in FIG. 2 at all times. Hence, when the operating knobs 25 and 27 are depressed, the contact holders 30 and 32 are moved from the initial positions to the forward positions against the elastic forces of the springs 45 and 47 with the aid of the coupling pieces 36*b* and 38*b* of the knob bodies 36 and 38. In FIG. 2, the first switch 14 is at the initial position, and the second switch 26 is at the forward position. On the rear side of the contact holders 30 and 32 (on the right side in FIG. 3), an armature 48 is provided to open and close contact means (not shown) of the printed circuit board 34. That is, when the above-described contact holders 30 and 32 are moved to the initial positions and to the forward positions, the armature opens and closes the contact means.

A mechanism will now be described in brief which moves the first and second switches 24 and 26 between the initial position and the forward position (the forward movement, and the return movement) in response to the depression thereof. Those movements of the switches relate to predetermined cam grooves 30*a* and 31*a* formed in the contact holders 30 and 32, rock springs 50 and 52 whose first ends are engaged with the cam grooves, and the aforementioned springs 45 and 47. The cam grooves 30*a* and 32*a* are bisymmetrical. The rock springs 50 and 52 are built in the housing 22 with their first ends in contact with the bottoms of the cam grooves 30*a* and 32*a*. The remaining ends of the rock springs 50 and 52 are secured to the housing 22 at predetermined positions. And, in the case of the first switch 24, the first end of the rock spring 50 is regulated as follows: That is, the bottom of the cam groove 30*a* has a recess in which the first end of the rock spring 50 is allowed to go when the first switch 24 is at the initial position (hereinafter referred to as "an initial position regulating recess", when applicable), and a recess in which the first end of the rock spring 50 is allowed to go when the first switch is at the forward position (hereinafter referred to as "a forward position regulating recess", when applicable).

Hence, when the operating knob 25 of the first switch which is at the initial position is depressed, the contact holder 30 is pushed by the coupling piece 36*b* against the elastic force of the spring 45 as was described above, so that the first end of the rock spring 50 is shifted from the initial position regulating recess. Thereafter, the contact holder 30 is moved forwardly in the region 44 with the first end of the rock spring 50 along the cam groove 30*a* . And, when the first switch 24, being pushed to the full stroke position, is released, the first end of the rock spring 50 is engaged with the forward position regulating recess, so that the contact holder 30 is held at the forward position by the rock spring 50. Hence, the operating knob 25 is held at the forward position. On the other hand, when the operating knob 25 at the forward position is depressed again, the first end of the rock spring 50 is disengaged (shifted) from the forward position regulating recess. Hence, the contact holder 30 and the operating knob 25 are returned to the initial positions by the elastic force of the spring 45, and the first end of the rock spring is engaged with the initial position regulating recess.

The same may be said about the second switch 26 in operation and in the behavior of the rock spring.

Now, a cancel mechanism for realizing the cancel return of the first and second switches 24 and 26, will be described. The cancel return relates to the engaging protrusions 30*b* and 32*b* of the contact holders 30 and 32, and a cancel plate 54. The cancel plate 54 is swingably inserted in a protrusion formed on the wall 28b of the body 28. When any one of the first and second switches 24 and 26 is moved forwardly from the initial position, the cancel plate 54 is turned in one direction by the engaging protrusions 30b and 31b of the contact holders 30 and 32. When, in the case where the second switch 26 is at the forward position as shown in FIG. 2, the first switch 24 is depressed, the cancel plate 54 is turned clockwise in FIG. 2 by the engaging protrusion 30b of the contact holder 30. As a result, the cancel plate 54 pushes the rock spring 52 of the second switch 26 to the left in FIG. 2, to shift the first end of the rock spring 52 from the forward position regulating recess. As a result, the second switch 26 at the forward position is returned to the initial position by the elastic force of the spring 47. The same thing may be said about the case where the second switch 26 is depressed with the first switch 24 held at the forward position.

Figure 4:
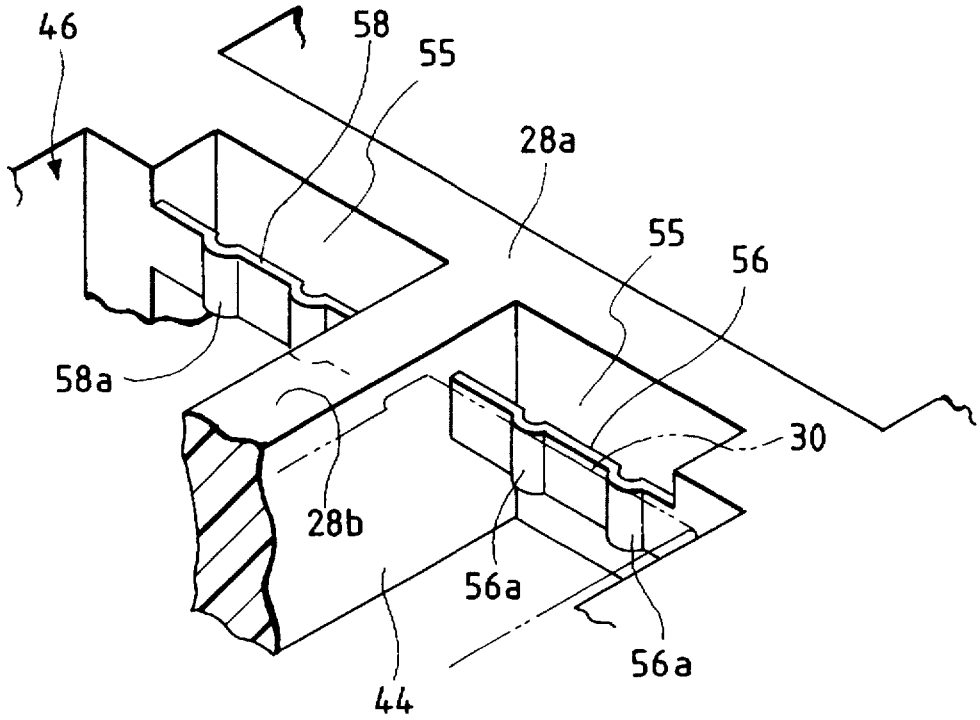
FIG. 4 is an explanatory diagram showing stoppers provided on the body of the push-button switch, for a description of the function and effect of those stoppers.

The contact holders 30 and 32 returning from the forward position to the initial position, are stopped by striking against the stoppers 56 and 58 of the body 28. In this operation, the first ends of the rock springs 50 and 52 are engaged with the initial position regulating recesses. Those stoppers 56 and 58 are as shown in FIG. 2 and in FIG. 4 (an enlarged perspective view). That is, the stoppers 56 and 58 are integral with the wall 28b of the body 28 which defines the aforementioned regions 44 and 46, and are in parallel with the other wall 28a which also defines the regions 44 and 46. The stoppers 56 and 58 are each in the form of a thin plate, having protrusions 56a and 58a which are projected towards the respective contact holders. When the contact holders 30 and 32 are returned to the initial positions, the protrusions 56a and 58a strikes against the contact holders 30 and 32. As was described above, the stoppers 56 and 58 are in the form of thin plates. Therefore, when the contact holders 30 and 32 strike against the protrusions 56a and 58a, which are curved in such a manner as to reduce the distances 55 between the wall 28a and the stoppers 56 and 58.

Hence, the impact on the contact holders 30 and 32 through striking is lessened by the flexure of the stoppers 56 and 58. Therefore, not only in the cancel return of the first and second switches 24 and 26 but also in the single return of each switch, when the contact holders 30 and 32 strike the stoppers 56 and 58, the impact sound generated thereby is lower in volume. The stoppers 56 and 58 are formed integral with the wall 28b of the body 28 of the housing 22 which defines the regions 44 and 46 in which the contact holders 30 and 32 are accommodated. This feature makes it unnecessary to assemble the stoppers 56 and 58. Hence, with the push-button switch 20 of the invention, the impact sound produced in the return (the single return and the cancel return) of the contact holders 30 and 32 is low in volume. Furthermore, the push-button switch 20 is lessened in the number of manufacturing steps, and in manufacturing cost.

The stoppers 56 and 58, after being bent in the above-described manner, are restored. Hence, the contact holders 30 and 32 are smoothly returned to the initial positions, and the rock springs are also smoothly engaged with the initial position regulating recesses; that is, the switches are able to take the initial positions again with high reliability.

While there has been a detailed description in connection with the preferred embodiment of the invention, the invention is not limited thereto or thereby, and it will be obvious to those skilled in the art that various changes and modifications may be made therein without departing from the invention.

For instance, the stoppers 56 and 58 may be each in the form of a thin plate having no protrusion. However, in this case, preferably, the contact holders 30 and 32 have protrusions.

The interlocking type push-button switch 20 having the first and second switches 24 and 26 have been described as the preferred embodiment of the invention. However, it goes without saying that the technical concept of the invention is applicable to a push-button switch having only one switch which is turned on and off when depressed.

Figure 5:
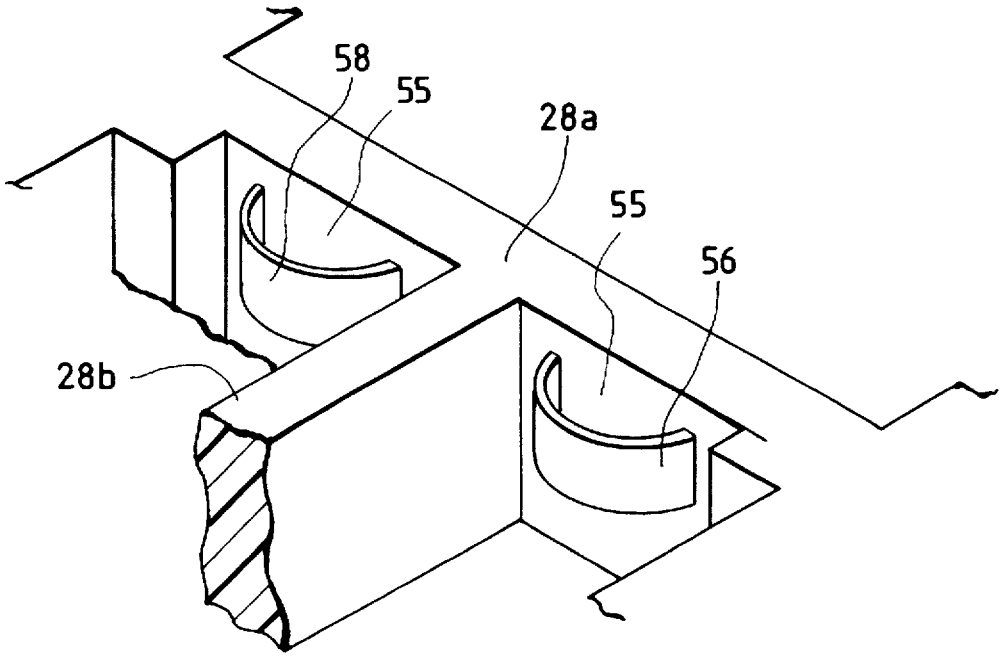
FIG. 5 is an explanatory diagram showing one modification of the stoppers, for a description of the function an effect of those stoppers.

In the above-described embodiment, the stoppers 56 and 58 are formed integral with the partition wall 28b of the body 28; however, the invention is not limited thereto or thereby. That is, as shown in FIG. 5, the stoppers 56 and 58 may be made integral with another wall 28a which also defines the regions 44 and 46. In this modification, the stoppers 56 and 58 are each in the form of an outwardly curved thin plate, so that, when the contact holders 30 and 32 strike against the stoppers 56 and 58, the latter are bent to decrease the impact thereon, and accordingly the impact sound.

What is claimed is:

1. A push-button switch comprising:

a switch mechanism including:

a casing;

a spring, a movable member accommodated in a region which is defined in said casing, wherein when a knob is depressed as required, said movable member is moved from an initial position to a forward position against the elastic force of said spring, and when a predetermined condition is satisfied, the elastic force of said spring causes said movable member to return to said initial position; and a flexible stopper, provided at said initial position, for stopping said movable member when said movable member is returned, said stopper being formed integral with a wall of said casing which defines said region, serving as an elastic piece for absorbing an impact on said movable member when said movable member is returned by said spring.

2. A push-button switch as claimed in claim 1, in which said predetermined condition is defined by depressing said knob again.

3. A push-button switch comprising:

first and second switch mechanisms each of which includes:

a casing;

a spring and a movable member accommodated in a region which is defined in said casing, when a knob is depressed as required, said movable member is moved from an initial position to a forward position against the elastic force of said spring, and when said knob is depressed again, the elastic force of said spring causes said movable member to return to said initial position;

a cancel mechanism for forcibly returning said movable member of said one switch mechanisms to said initial position by elastic force regardless of said knob depressed again under the condition that when said movable member of one of said first and second switch mechanisms is at said forward position, a predetermined amount of depression is applied to the other switch mechanism; and a flexible stopper, provided at said initial position of each of said first and second switch mechanisms, for stopping said movable member when said movable member is returned, said stopper being formed integral with a wall of said casing which defines said region, serving as an elastic piece for absorbing an impact on said movable member when said movable member is returned by said spring.

4. A push-button switch as claimed in claim 1, wherein said flexible stopper is formed of a thin plate.

5. A push-button switch as claimed in claim 4, wherein said thin plate has a protrusion formed therein.

6. A push-button switch as claimed in claim 4, wherein the thin plate is outwardly curved.

7. A push-button switch as claimed in claim 5, wherein the thin plate is outwardly curved.

8. A push-button switch as claimed in claim 3, wherein said flexible stopper is formed of a thin plate.

9. A push-button switch as claimed in claim 8, wherein said thin plate has a protrusion formed therein.

10. A push-button switch as claimed in claim 8, wherein the thin plate is outwardly curved.

11. A push-button switch as claimed in claim 9, wherein the thin plate is outwardly curved.

* * * * *